United States Patent [19]

Sakai et al.

[11] Patent Number: 4,721,339

[45] Date of Patent: Jan. 26, 1988

[54] ROCK CRUSHING DEVICE AND A METHOD THEREOF

[75] Inventors: Mituya Sakai, Kashiwara; Kenji Hagimori; Toshinori Asahi, both of Osaka, all of Japan

[73] Assignee: Okumura Corporation, Osaka, Japan

[21] Appl. No.: 790,534

[22] Filed: Oct. 23, 1985

[30] Foreign Application Priority Data

Oct. 23, 1984 [JP] Japan ..... 59-160155

[51] Int. Cl.[4] ..... E21C 37/06

[52] U.S. Cl. ..... 299/1; 299/21

[58] Field of Search ..... 299/1, 16, 10, 20–22

[56] References Cited

U.S. PATENT DOCUMENTS 2,211,243 8/1940 Meyer ..... 299/16

4,301,731 11/1981 Fitzgerald ..... 299/21 X

FOREIGN PATENT DOCUMENTS 2544393 4/1977 Fed. Rep. of Germany ..... 299/16

*Primary Examiner*—Stephen J. Novosad

*Assistant Examiner*—David J. Bagnell

*Attorney, Agent, or Firm*—Birch, Stewart, Kolasch and Birch

[57] ABSTRACT

A rock crushing device which crushes a rock by an expandable member which is, after being inserted into a borehole formed in the rock, expanded by pressure of a liquid material injected thereinto, including a liquid pressure measuring device provided in a liquid supply hose and a processor connected to the liquid pressure measuring device for processing the liquid pressure converted into electric signals and the time interval during which the liquid pressure is measured, wherein a valve provided in the liquid supply hose is controlled to be closed when the value of the value corresponding to the decreased pressure of liquid material of the liquid pressure measured by the processor exceeds a predetermined value.

4 Claims, 7 Drawing Figures

ROCK CRUSHING DEVICE AND A METHOD THEREOF

BACKGROUND OF THE INVENTION

1. Field of the Invention

The present invention relates to a rock crushing device for crushing a rock by the utilization of an expandable member which is, after being inserted into a borehole formed in the rock, expanded by the pressure of a liquid material injected thereinto, and a method thereof.

2. Description of the Prior Art

In recent years, a crushing device of the type referred to above using an expandable member has been developed that crushes the rock in the following manner. Namely, after the expandable member made of rubber or synthetic resin is inserted into a borehole formed in the rock to be crushed, a liquid material is pumped into the expandable member by a high-pressure pump. Due to the expansive pressure of the expandable member acting on the wall of the borehole, a crack or cracks are produced in the rock.

Moreover, if a plurality of expandable members are inserted into boreholes formed in the rock one for each borehole, and the liquid material is pumped into these expandable members by a single pump at one time, a high crushing efficiency can be achieved by the above crushing device.

However, in the prior art crushing device as mentioned above, if the liquid material is continuously supplied even when cracks are generated in the rock by the expandable members pressed against the walls of the boreholes, the cracks become still larger in size and some of the expandable members may enter into the cracks, resulting in undesirable breakage or damage to the expandable members.

Accordingly, for avoiding damage to the expandable members, although it is enough to stop the supply of the liquid material when the cracks are generated, it has been considerably difficult to make sure whether the cracks are really generated in the rock, since the rock mass is not uniform in its nature, due to its having joints or hard and soft portions.

Further, when a plurality of boreholes are to be crushed instantaneously, it is a disadvantage that the cracks cannot be formed simultaneously in the boreholes. In many cases, even when cracks are generated in some of the boreholes, a crack is not formed in the others. Moreover, an additional supply of the liquid material after the generation of the cracks in the boreholes causes adverse effects to the expandable members in the cracked boreholes. In other words, the cracks become larger and the expandable members easily come into the cracks, thereby being damaged and disabled. Once some of the expandable members are damaged, the remaining ones cannot be applied with more pressure due to a leakage of the liquid material from the damaged one, resulting in the impossibility of crushing the rock. Thus, the prior art crushing device is disadvantageous in that it has low operating efficiency and is uneconomical.

SUMMARY OF THE INVENTION

The present invention has been developed with a view to substantially solving the above described disadvantages or inconveniences inherent in the prior art crushing devices, and has for its essential object to provide an improved rock crushing device and a method for crushing a rock by the pressure of a liquid material injected into expandable members inserted into a plurality of boreholes formed in the rock, which is so designed that the supply of the liquid material into the expandable members is automatically stopped when cracks of a desired size are formed in the boreholes.

In accomplishing this and other objects of the present invention, there is provided an improved rock crushing device which crushes a rock in the manner that an expandable member which is, after being inserted into a borehole formed in the rock, expanded by the pressure of a liquid material injected thereinto, comprising a liquid pressure measuring device provided in a liquid supply hose and a processor connected to the liquid pressure measuring device for processing the liquid pressure converted into electric signals and the time interval during which the liquid pressure is measured, wherein a valve provided in the liquid supply hose is controlled to be closed when the valve of the decrease amount of the liquid pressure measured by the processor exceeds a predetermined value. Also, there is provided a method for crushing a rock by an expandable member which is, after being inserted into a borehole formed in the rock, expanded by the pressure of a liquid material injected thereinto through a hose provided with an electro-magnetic stop valve, comprising a step of measuring the liquid pressure injected into the expandable member by a liquid pressure measuring device provided in the hose, a step of processing the measured liquid pressure in sequence by a processor connected between the liquid pressure measuring device and electro-magnetic stop valve so as to compare with a predetermined value of pressure or time interval, and a step of controlling the electro-magnetic stop valve to be closed when the decrease amount of liquid pressure obtained by the processor exceeds the predetermined value of pressure, or when the condition in which the liquid pressure is decreasing is continued for the predetermined value of time interval.

The relationship between the time interval T, while the liquid is injected into the expandable member, and the pressure P acting on the liquid, in the case where a pump having a given amount of discharge per hour is employed when the liquid with high pressure is supplied to the expandable member inserted into the borehole formed in the rock, is shown in FIGS. 3 to 5.

More specifically, FIG. 3 is a graph showing the relationship between the time interval T and the pressure P in the case where the liquid pressure increases in proportion to the injected amount of the liquid acting on the expandable member until a certain time $t_1$ is passed, and the pressure begins to decrease suddenly when it reaches a predetermined level, with providing a pressure drop a for a certain period of time $(t_2-t_1)$. FIG. 4 shows the relationship between the time interval T and the pressure P in the case where the pressure hardly changes around a certain value $P_1$ for a given interval b even through injection of the liquid material after the pressure reaches a certain level, and it begins to decrease through further injection of the liquid. FIG. 5 shows the relationship between the time interval T and the pressure P in the case where the pressure increases with a fixed inclination with respect to the time interval $t_1$ up to a certain level $P_1$, and then, it increases with a smaller slope for a short period of time $(t_4-t_1)$, and suddenly it begins to decrease.

It may be considered that the difference seen from the drawings is dependent on the nature of the rock mass, that is, the hardness, the fragility, the existence or absence of joints, or the combination of these characteristics. However, when the rock is crushed through the borehole by the pressure of the expandable member to be inserted into the borehole and injected with the liquid thereinto, these characteristics for the rock mass cannot be correctly understood.

In this connection, these characteristics of the rock mass relating to the generation of a crack or cracks to be produced through the hollow can be understood by measuring the injected amount of the liquid, namely, the time interval during which the liquid is injected, and the pressure of the liquid.

In other words, it can be considered that a crack is formed in the rock when more than a predetermined amount of the decrease of liquid pressure is observed suddenly after the highest pressure is generated, or when a fixed amount of the liquid is injected, that is, a predetermined time is passed, after the highest pressure is generated.

Accordingly, the crushing device of the present invention is designed so that the supply of the liquid into the expandable member is controlled to be stopped by detection of the change in the injected amount (the injection time) of the liquid and the generated pressure so as to prevent the crack from growing undesirably, thereby avoiding breakage of the expandable member.

BRIEF DESCRIPTION OF THE DRAWINGS

This and other objects and features of the present invention will become apparent from the following description taken in conjunction with one preferred embodiment thereof with reference to the accompanying drawings, wherein.

DETAILED DESCRIPTION OF THE EMBODIMENT

Figure 1:
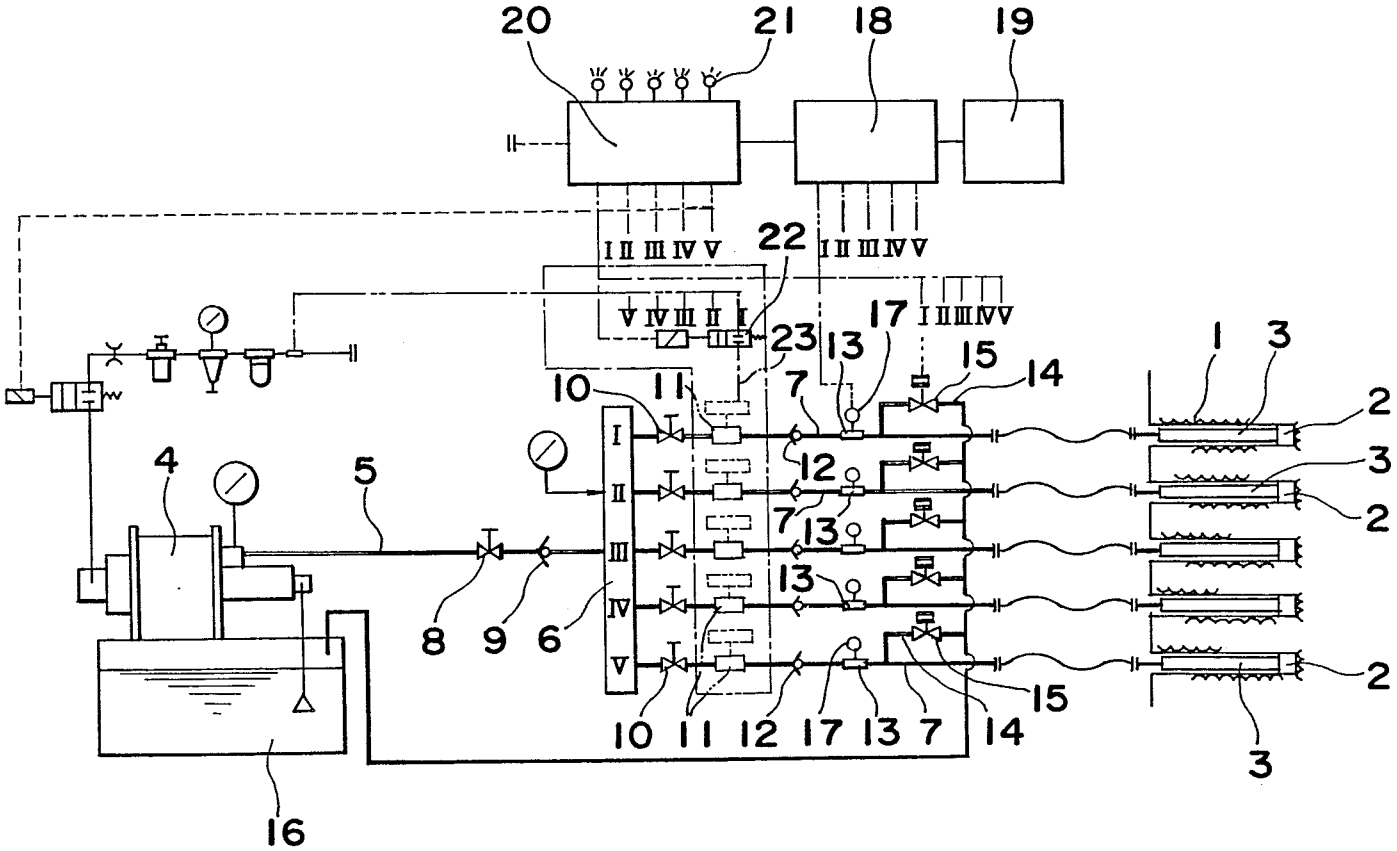
FIG. 1 is a schematic diagram, with solid lines representing liquid piping and dotted lines representing electric circuits, of a rock crushing device according to one preferred embodiment of the present invention.

Before the description of the present invention proceeds, it is to be noted that like parts are designated by like reference numerals throughout the accompanying drawings.

Referring to FIG. 1, a plurality of boreholes 2, having an adequate diameter and an adequate depth for inserting an expandable member 3, are formed in a rock or a rock mass 1 to be crushed, spaced a suitable distance from each other. The expandable member 3 is made of rubber or synthetic resin in the configuration of a hollow cylinder, and can be, after being inserted into each of the hollows 2, expanded in a direction of the outer periphery thereof through injection of a liquid material into the interior of the hollow cylinder for crushing the rock.

Figure 2:
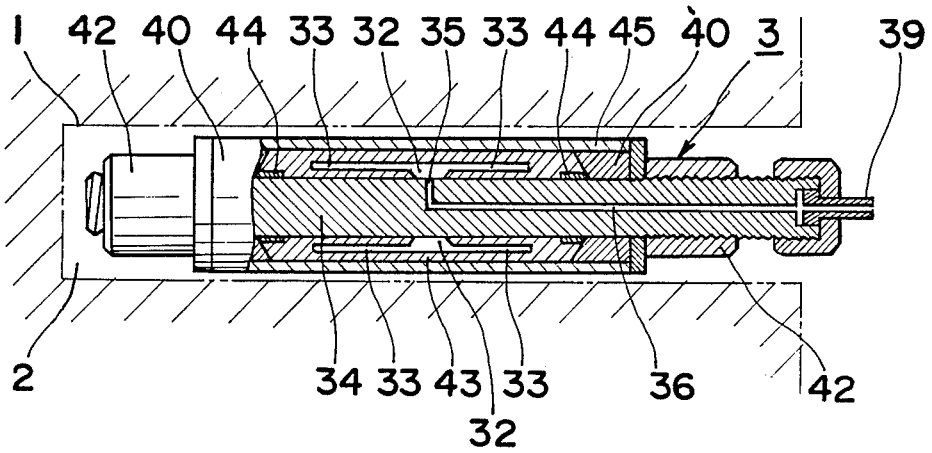
FIG. 2 is a cross-sectional view showing an expandable member employed in the device of FIG. 1.

The expandable member 3 is constructed, for instance, as shown in FIG. 2, as a rock crushing device for crushing the rock on the application of fluid pressure thereto, which comprises a shaft 34 of a length provided along its center axis with a fluid passage 36, one end of which is opened at the end 39 of the shaft to be connected to a pressure fluid source, while the other end of the passage is provided with an outlet 35 opening to the outside at the middle of the outer peripheral surface of the shaft; an elastic member 43 made of expandable material in cylindrical shape having an outer diameter capable of insertion into the borehole with a small gap and an inner diameter capable of receiving the shaft 34 therein in a tight relationship therebetween, and provided with at least a pair of looped pockets 33, 33 each disposed within the middle portion of the elastic member 43 opposite to the other in the axial direction of the elastic member 43 and expandable when receiving pressure fluid therein, the looped pockets 33 having ports 32 disposed at positions biasing to the center on the inner surface of the elastic member 43 in a manner that pressure fluid is supplied from the outlet of the shaft 34 into the looped pockets 33 through the ports 32 without discharging to the outside; a pair of fixtures 42, 42 each mounted on the shaft at the respective end of the elastic member so as to prevent the elastic member 43 from expanding along the axial direction of the shaft beyond the fixtures, a pair of elastic rings 40, 40 each having almost the same diameter as that of the elastic member and provided between the respective fixture and the elastic member so as to protect the elastic member from expanding beyond the fixture, a cover tube 45 for covering the whole outer periphery of the elastic member so as to reinforce the strength of the elastic member, and a pair of metal rings 44, 44 each embedded at the respective end portion of the elastic member for preventing the elastic member from warping at the end portion, whereby the elastic member 43 can expand only in its radial direction to crush the rock when the pressure fluid is supplied into the pockets of the elastic member through the fluid passage 36.

Referring back to FIG. 1, there is shown a booster pump 4 which is operated to add pressure by air onto liquid stored in a tank 16, and is connected to each of the expandable members 3 through a high pressure liquid supply hose 5, a divergent tube 6 and high pressure liquid supply hoses 7 each being branched from the tube 6, so as to feed the liquid stored in the liquid tank 16 in a compressed state into the interior of each of the hollow cylinders of the expandable member 3.

The liquid supply hose 5 between the booster pump 4 and the divergent pipe 6 is provided with a stop valve 8 and a backflow prevention valve 9. Moreover, each of the hoses 7 diverging from the divergent tube 6 is provided with a manual stop valve 10, an air stop valve or an electro-magnetic stop valve 11, a backflow prevention valve 12 and a pressure measuring device 13 in order along the line of hose 7 from the tube 6 to the expandable member 3.

In addition, between the pressure measuring device 13 and expandable member 3, each of the hoses 7 is connected with the one end of a feed-back pipe 14 having an air stop valve or an electro-magnetic valve 15, the other end of which is linked to the tank 16.

The pressure measuring unit 13 is equipped with a pressure converter 17 which changes the pressure measured by the device 13 into electric signals. The thus-obtained electric signals are fed to a processor 18 and a memory 19 both connected in series to the pressure converter 17 so as to actuate pilot lamps 21 installed in a control device 20 electrically connected to the processor 18, electro-magnetic air switching devices 22 electrically connected between air stop valves 11 and the processor 18 in correspondence with the respective pressure measuring devices 13, and electro-magnetic stop valves 15 of the feed-back pipes 14 each electrically connected to the processor 18 in parallel to the corresponding electro-magnetic air switching device 22, thereby operating each of the air stop valves 11 and, at the same time, the corresponding electro-magnetic stop valve 15 through the processor 18 upon the actuation of signal from the pressure measuring unit 13. It is to be noted here that the electro-magnetic stop valves 11 may be actuated by electric signals from the control device 20.

The air switching device 22 is connected to the air stop valves 11 through a pipe 23 for supplying air from a compressor (not shown).

Next, the operation of the crushing device according to the present invention will be described hereinbelow.

First of all, after a plurality of boreholes 2 are formed in the rock 1, spaced a suitable distance from each other, an expandable member 3 is inserted into each of the boreholes 2. Then, manual stop valves 8 and 10 are opened, while on the other hand, the electro-magnetic stop valves 15 are closed, with the booster pump 4 being started, so that the liquid is supplied through the supply hose 5, the divergent tube 6 and the divergent hoses 7 to the expandable member 3. As a result, the expandable members 3 are expanded, and the outer surfaces of the expandable members 3 are brought into close contact with the wall of the boreholes 2. If the additional liquid is supplied, the expandable members 3 are closely pressed against the wall of the boreholes 2 in the rock 1, thereby increasing the pressure of the liquid stored in the hollow cylinder of the expandable member 3.

This pressure of the liquid is measured by the pressure measuring device 13 in each of the hoses 7 and converted into electric signals by the pressure converter 17. The electric signals are sent out from the pressure converter 17 to the processor 18 and then recorded by the memory 19. The processor 18 is operated to deal with the electric signals to control the closing and opening of each of the electromagnetic stop valves 11 and 15 in specific ways. One example of the operation of the processor 18 will be described in accordance with a flow chart as shown in FIG. 6.

Figure 3:
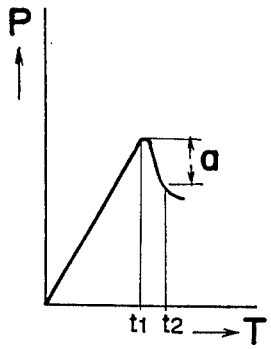
FIGS. 3 to 5 are graphs, each showing a relationship between the liquid pressure and the time interval while the liquid is injected into the expandable member.
Figure 6:
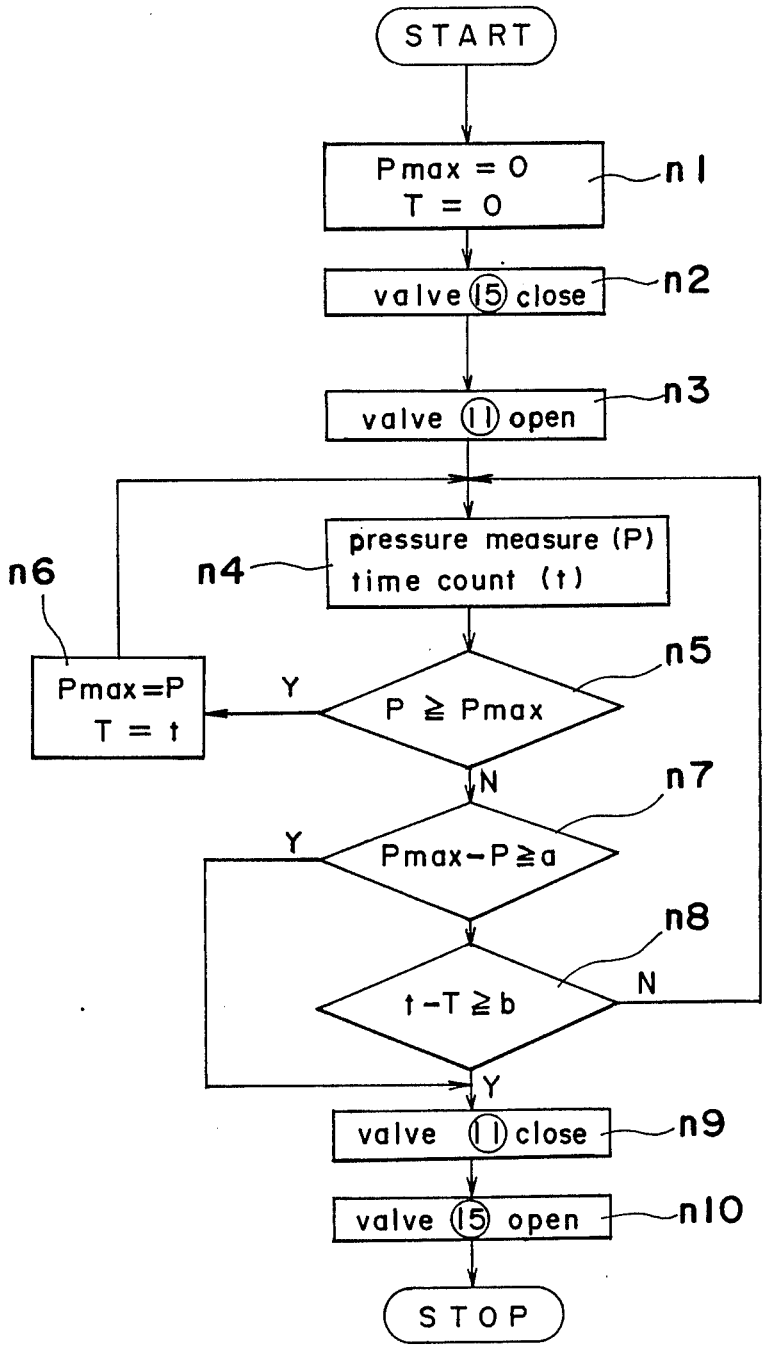
FIGS. 6 and 7 are flow-charts showing operations of a processor employed in the device of the present invention, respectively.

In the embodiment of FIG. 6, including steps n1 to n10, a predetermined maximum pressure value Pmax is initially set in the processor 18. The processor 18 is adapted to receive from the pressure converter 17 digital signals, each representing a pressure value P at the respective time, to be generated at every given time interval, and to compare the pressure value P with the predetermined maximum pressure value Pmax in sequence. If the condition of $P \geqq Pmax$ is established, the maximum pressure value Pmax is changed from $(Pmax-0)$ to $(Pmax=P)$ and a maximum pressure measuring time T having been initially predetermined is changed from $(T=0)$ to $T=t$, and then, the processor is going to receive the next digital signal to do the above same process in a repeating cycle. As the result, when the condition of $(Pmax \geqq P)$ is obtained within the processor 18 and the equation of $(Pmax-P \geqq a)$, wherein a is a positive real number predetermined to be given a certain pressure difference in accordance with the property of rock, (as shown in FIG. 3), is once established, the processor 18 immediately outputs an electric signal to the control device 20 to turn on the corresponding lamp 21, to open the electro-magnetic stop valve 15, thereby to exhaust the pressure liquid from the corresponding expandable member 3 through the feed back pipe 14, and to actuate the electro-magnetic air switching device 22, thereby to feed air to the corresponding electro-magnetic stop valve 11 to stop the liquid supply to the respective hose 7.

Figure 4:
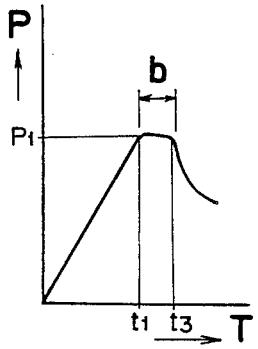

However, if the condition of $(Pmax-P \geqq a)$ is not obtained, the calculation of $(t-T \geqq b)$, where b is a positive real number predetermined to be given a certain time in accordance with the durability of the expansive member 3, as shown in FIG. 4, is made in succession. When the condition of $(t-T \geqq b)$ is established, all of the pressure measuring devices 13 are represented with the same pressure value, and all of the electro-magnetic stop valves 11 are closed, but all of the electro-magnetic stop valves 15 are opened, thereby to exhaust liquid stored in the expandable member 3 through the respective feed back hose 14. The above condition occurs when the large pressure drop within the expandable member 3 is not rapidly generated so as to keep a certain pressure for a given period of time b under receiving pressure liquid in the expandable member even though a crack or cracks are produced and developed to a certain extent in the rock 1. At this condition, since all of the boreholes 2 in the rock 1 are not always provided with cracks but all of the expandable members 3 are supplied with pressure liquid for the same time, when the condition of $(t-T \geqq b)$ is once established, all of the electro-magnetic stop valves 11 are closed and all of the electro-magnetic stop valves 15 are opened. Then, in this condition, the outer surface of the rock is observed by an operator, and the corresponding manual stop valve 10 provided in the hose 7 of the expandable member, which is inserted into a borehole of the rock having a a crack or cracks, is closed, and the other electro-magnetic stop valves 11 having been closed are opened and the respective other electro-magnetic stop valves 15 are closed, thereby to supply pressure liquid into the other expandable members. By the way, if both the conditions of $(Pmax-P \geqq a)$ and $(t-T \geqq b)$ are not established, the feeding of pressure liquid from the tank 16 to the expandable members 3 and the measuring of pressure by the respective pressure measuring devices 13 are made continuously to do the above calculation in the processor 18 until the electro-magnetic stop valves 11 and 15 are operated.

Figure 5:
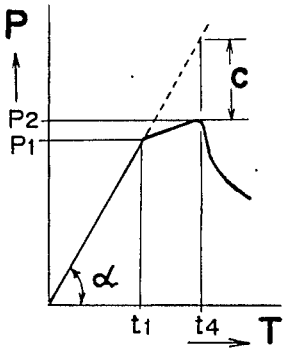
Figure 7:
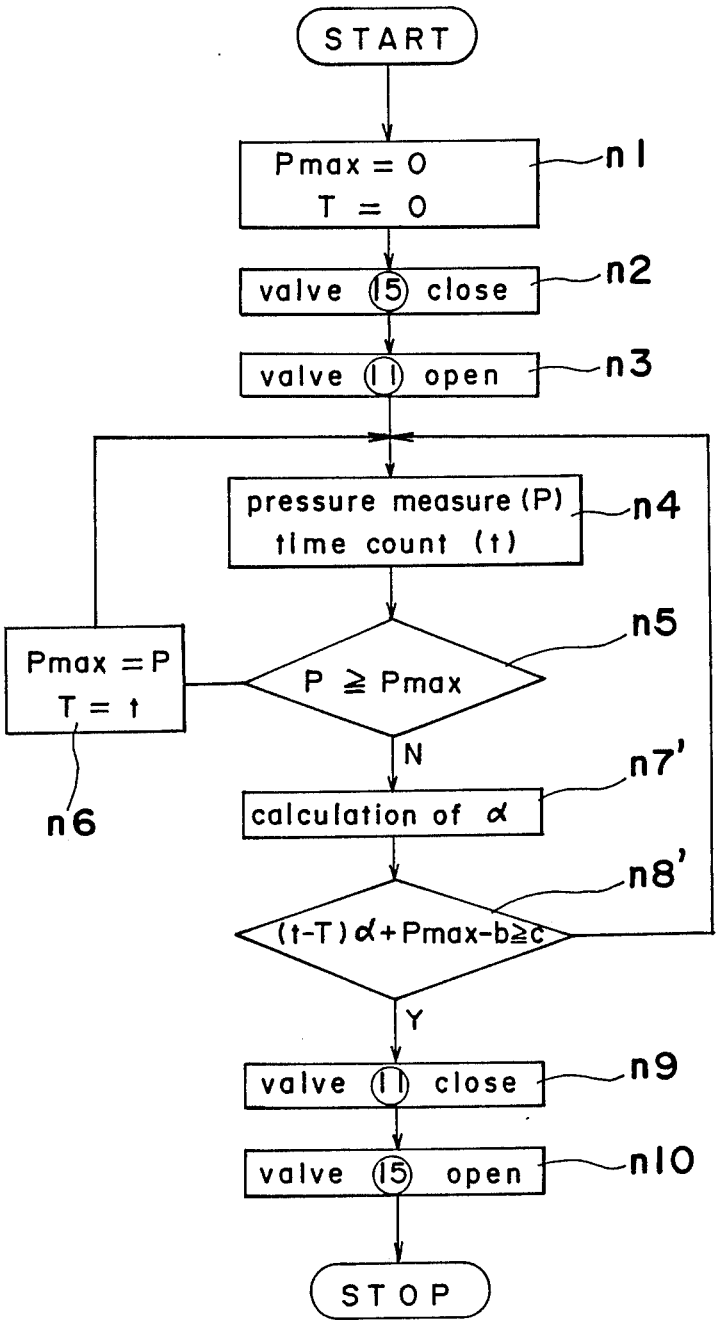

Also, the processor 18 may be operated in accordance with a flow chart of FIG. 7. In the embodiment of FIG. 7, including steps n1 to n6, n7', n8', n9 and n10, if the condition of $(P \geqq Pmax)$ does not become established, the maximum pressure Pmax and the corresponding time T are stored in the memory 19. This condition is to be considered in that a crack or cracks are generated and developed in the rock. Next, on the employment of pressure measuring values obtained at several measuring times before the measuring time T of the pressure value P, the relationship between the pressure values and the corresponding times is applied in a primary regression, and the rising-up rate $\alpha$ of the generating pressure to the pressure time is obtained. With the value of $\alpha$, an equation of $(t-T)\alpha+Pmax-P \geqq C$ is calculated, wherein C is a positive real value of a pressure difference to be determined by the durability of the expandable member 3 or the property of the rock as shown in FIG. 5. When the the above relationship is satisfied, the electro-magnetic stop valves 11 are closed and the electro-magnetic stop valves 15 are opened. On the other hand, if the the above relationship is not satisfied, the feeding of pressure liquid to the expandable members 3 and the measuring by the respective pressure measuring devices 13 occur continuously until the above relationship is satisfied to actuate the electro-magnetic stop valves 11 and 15. The above condition is to be considered that a crack or cracks for the boreholes are generated in the rock at the time of generating a certain pressure difference between a real measuring pressure value P and an ideal pressure value to be obtained if the pressure drop has not occurred in the expandable member with a certain time of (t−T).

Thus, in the crushing device of the present invention, the liquid pressure acting on each of the expandable members 3 is changed into electric signals which are processed by the processor, so that, when the decrease amount of the liquid pressure measured by the processor is over a predetermined amount, or when the decrease of the liquid pressure is continued for a predetermined time, the stop valve at the side of the subject expandable member 3 is closed to stop the supply of the liquid, maintaining the state in which a desired crack is formed in the rock, and at the same time, preventing the expandable member from coming into the crack.

As is clear from the foregoing description, according to the crushing device of the present invention for crushing a rock by an expandable member which is, after being inserted into a borehole formed in the rock to be crushed, expanded through the pressure of a liquid injected thereinto, since the valve provided in the liquid supply hose is controlled to be automatically closed when the decrease amount of the liquid pressure goes over a predetermined value after the increase of the pressure is stopped or nearly stopped, or when the condition where the liquid pressure is decreasing lasts for over a predetermined time, it is advantageous that uniform cracks can be formed in the rock irrespective of the nature of the rock, and at the same time the cracks never become larger than desired. Therefore, the expandable member is prevented from being damaged by coming into the crack. Moreover, the expandable member is able to be easily taken out of the hollows, that is, it can be reused easily. Thus, the crushing device according to the present invention can achieve high operational efficiency and reduction of cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for crushing a rock comprising the steps of:

inserting an expandable member into a borehole formed in the rock;

expanding said expandable member in response to pressure of a liquid material by injecting thereinto said liquid material from a source;

measuring the instantaneous liquid pressure injected into the expandable member by a liquid pressure measuring device;

processing the measured instantaneous liquid pressures at respective time intervals by a processor connected to said liquid pressure measuring device which has established therein an initial predetermined pressure value and a certain pressure difference value;

comparing in sequence, by said processor, said measured instantaneous liquid pressures with said initial predetermined pressure value;

updating said initial predetermined pressure value with said measured instantaneous liquid pressure if said measured instantaneous liquid pressure exceeds said initial predetermined pressure value so as to determine a maximum measured instantaneous pressure;

obtaining, by said processor after said initial predetermined pressure has been updated to be said maximum measured instantaneous pressure, a pressure difference value which represents the difference between said initial predetermined pressure and said measured instantaneous pressure; and stopping the injection of liquid material into said expandable member when said pressure difference value processed by the processor in consecutive measurements of said instantaneous pressure measured by the measuring device exceeds the certain pressure difference value.

2. A method for crushing a rock comprising the steps of:

inserting an expandable member into a borehole formed in the rock;

expanding said expandable member in response to pressure of a liquid material by injecting thereinto said liquid material from a source;

measuring the instantaneous liquid pressure injected into the expandable member by a liquid pressure measuring device;

processing the measured instantaneous liquid pressures at respective time intervals by a processor connected to said liquid pressure measuring device, which has established therein an initial predetermined pressure value, a certain pressure difference value, a certain time interval and a maximum pressure measuring time;

comparing in sequence, by said processor, said measured instantaneous liquid pressures with said initial predetermined pressure value;

updating said initial predetermined pressure value with said measured instantaneous liquid pressure if said measured instantaneous liquid pressure exceeds said initial predetermined pressure value so as to determine a maximum measured instantaneous pressure;

obtaining, by said processor after said initial predetermined pressure has been updated to be said maximum measured instantaneous pressure, a pressure difference value which represents the difference between said initial predetermined pressure and said measured instantaneous pressure;

updating said maximum pressure measuring time to be a value of time necessary to obtain said maximum measured instantaneous pressure;

obtaining by said processor, after said maximum measured instantaneous pressure has been determined, a time difference value between said maximum pressure measuring time and said time of measurement of said instantaneous pressures; and controlling a stop valve to be closed when said pressure difference value processed by said processor in consecutive measurements of said instantaneous pressure is lower than said certain pressure difference value, and said time difference value exceeds said certain time interval.

3. A rock crushing device for crushing a rock comprising:

an expandable member connected to a liquid source by a liguid supply conduit for being expanded by pressure of liquid material injected thereinto after said expandable member has been inserted into a borehole formed in the rock;

a liquid pressure measuring device provided in said conduit for measuring an instantaneous liquid pressure of said liquid injected into said expandable member;

a processor connected to said liquid pressure measuring device and having established therein an initial predetermined pressure value and certain pressure difference value, for processing at respective time intervals the measured instantaneous liquid pressure, comparing in sequence said measured instantaneous liquid pressures with said initial predetermined pressures, updating said initial predetermined pressure value with said measured instantaneous liquid pressure if said measured instantaneous liquid pressure exceeds said initial predetermined pressure value so as to determine a maximum measured instantaneous pressure, obtaining after said initial predetermined pressure has been updated to be said maximum measured instantaneous pressure, a pressure difference value which represents the difference between said initial predetermined pressure value and said measured instantaneous pressure; and means for stopping the injection of liquid material into said expandable member when said pressure difference value processed by the processor in consecutive measurements of said instantaneous pressure measured by the measuring device exceeds the certain pressure difference value.

4. A rock crushing device for crushing a rock comprising:

an expandable member connected to a liquid source by a liquid supply conduit for being expanded by pressure of liquid material injected thereinto after said expandable member has been inserted into a borehole formed in the rock;

a liquid pressure measuring device provided in said conduit for measuring an instantaneous liquid pressure of said liquid material injected into said expandable member;

a processor connected to said liquid pressure measuring device and having established therein an initial predetermined pressure value, a certain pressure difference value, a certain time interval, and a maximum pressure measuring time, for processing at respective time intervals the measured instantaneous liquid pressure, comparing in sequence said measured instantaneous liquid pressures with said initial predetermined pressure value, updating said initial predetermined pressure value with said measured instantaneous liquid pressure if said measured instantaneous liquid pressure value exceeds said initial predetermined pressure value so as to determine a maximum measured instantaneous pressure, obtaining, after said initial predetermined pressure has been updated to be said maximum measured instantaneous pressure, a pressure difference value which represents the difference between said initial predetermined pressure and said measured instantaneous pressure, updating said maximum pressure measuring time to be a value of time necessary to obtain said maximum measured instantaneous pressure, and obtaining after said maximum measured instantaneous pressure has been determined, a time difference value between said maximum pressure measuring time and said time of measurement of said instantaneous pressures; and means for stopping the injection of liquid material into said expandable member when said pressure difference value processed by said processor in consecutive measurements of said instantaneous pressure is lower than said certain pressure difference value, and said time difference value exceeds said certain time interval.

* * * * *